US007247084B2

(12) United States Patent
Koh et al.

(10) Patent No.: US 7,247,084 B2
(45) Date of Patent: Jul. 24, 2007

(54) POLISHING HEAD ELBOW FITTING

(75) Inventors: Meng Fei Koh, Singapore (SG); Teck Leong Neo, Singapore (SG); Bing Wang, Singapore (SG)

(73) Assignee: Systems on Silicon Manufacturing Co. Pte. Ltd., Singapore (SG)

( * ) Notice: Subject to any disclaimer, the term of this patent is extended or adjusted under 35 U.S.C. 154(b) by 65 days.

(21) Appl. No.: 11/226,013

(22) Filed: Sep. 14, 2005

(65) Prior Publication Data

US 2007/0060031 A1 Mar. 15, 2007

(51) Int. Cl.
*B24B 29/00* (2006.01)
*B25B 27/00* (2006.01)

(52) U.S. Cl. ..... 451/285; 81/487

(58) Field of Classification Search ..... 451/283, 451/285, 286, 287, 288, 289, 291, 292
See application file for complete search history.

(56) References Cited

U.S. PATENT DOCUMENTS 5,957,007 A * 9/1999 Righini ..... 81/44
2003/0096564 A1* 5/2003 Numoto ..... 451/285
2004/0116049 A1* 6/2004 Stacklies ..... 451/41
2005/0153635 A1* 7/2005 Boo et al. ..... 451/285

* cited by examiner

*Primary Examiner*—Jacob K. Ackun, Jr.
(74) *Attorney, Agent, or Firm*—Harness, Dickey & Pierce, P.L.C.

(57) ABSTRACT

An improvement is provided for a wafer carrier having an annular inflatable tube for exerting pressure on the edge of a perforated plate during wafer dechucking, and a flexible plastic tube for supplying pressure to the annular inflatable tube. The improvement comprises a fixed elbow fitting secured to said head assembly. The elbow fitting is secured to the head assembly in a predetermined orientation, said orientation being such that said flexible plastic tube will not be obstructed in its path between said fitting and the said inflatable tube and will not obstruct the bellows operation of said wafer carrier. A tool for assisting fitting the fixed orientation elbow fitting in the predetermined orientation. The tool has a planar or substantially planar rigid body with an aperture shaped to accommodate the elbow fitting in one predetermined orientation relative to the tool. Edges of the tool are shaped to bear on features of the polishing head so that at least with the aperture for the fitting in position, the tool is positively located at a predetermined orientation, which, in turn, locates a fitting placed in the aperture in a predetermined orientation, so that it can be fixed in place.

19 Claims, 5 Drawing Sheets

POLISHING HEAD ELBOW FITTING

FIELD OF THE INVENTION

The present invention is directed toward an improved fitting for a polishing head and to a tool for use in installing the fitting.

SUMMARY OF THE PRIOR ART

The inventors have analysed the production and performance of wafer polishing apparatus operated by their employer. The wafer polishing apparatus is a MIRRA CMP polisher manufactured by Applied Materials Inc. of California USA. The polisher includes an 8 inch TITAN HEAD wafer carrier, also proprietary to Applied Materials Inc. of California USA. In the TITAN HEAD wafer carrier an annular tube inflates to exert pressure on the edge of a perforated plate during wafer dechucking. Dechucking is the step where the wafer is sucked off the polishing pad by vacuum after polishing. The edge pressure from the annular tube seals the side of the wafer, while the perforated plate, with a rubber or silicone membrane, forms an array of suction cups under the influence of the vacuum and lifts the wafer off the polishing pad. The wafer is then transferred to the next station within the CMP polisher.

The TITAN HEAD wafer carrier has a bellows like structure. During polishing the bellow like structure expands and pushes the wafer down onto the polishing pad. After polishing, the wafer is dechucked as described above and the bellows retracts so that the wafer can be transferred to another station. The inflatable tube assembly is attached to that part of the carrier which extends and retracts relative to a head assembly. Air pressure is supplied to the inflatable tube assembly from an air supply manifold in the head assembly of the TITAN HEAD wafer carrier. To allow for this movement air pressure is supplied between the supply manifold and the annular tube through a flexible plastic tube. At one end the flexible plastic tube is fitted to a swivelling elbow fitting at the other end the flexible plastic tube is fitted to a swivelling elbow fitting at the annular tube. The inventors have discovered that the swivelling elbow fittings are a significant cause of downtime and production failures for the polisher.

SUMMARY OF THE INVENTION

It is an object of the present invention to provide a fitting for the polishing head that goes some way towards overcoming this failure problem.

In a first aspect the present invention consists in an improvement for a wafer carrier having an annular inflatable tube for exerting pressure on the edge of a perforated plate during wafer dechucking, and a flexible plastic tube for supplying pressure to the annular inflatable tube, the improvement comprising a fixed elbow fitting secured to said head assembly, said fixed elbow fitting including a body having a first hollow spigot for receiving one end of said flexible plastic tube and a bore extending through said body at right angles to said hollow spigot between a top face of said body and a bottom face of said body, a seal sandwiched between said top face of said body and said head assembly, a hollow screw extending through said bore of said body of the pressure manifold of the head assembly, with a seal between the head of said screw and the bottom face of said body; with said body held clamped in a fixed position by said screw with said spigot in a predetermined orientation, said orientation being such that said flexible plastic tube will not be obstructed in its path between said fitting and the said inflatable tube and will not obstruct the bellows operation of said wafer carrier.

Each seal may comprise a resilient O-ring.

The side surface of said body of said fitting may have a non-circular outline.

The side surface of said body of said fitting may have a plurality of facets.

In a further aspect the invention may broadly be said to consist in a tool for assisting the fitting a fixed orientation elbow connector within a wafer carrier, said tool comprising a planar or substantially planar rigid body having an aperture shaped to accommodate the elbow fitting in one predetermined orientation relative to the tool, and edges shaped to bear on features of the polishing head so that with said aperture at the fixing position for said elbow fitting said tool maybe positively located at a predetermined orientation.

The aperture may have a portion shaped to accommodate a body of the fitting and a narrower portion extending from said first position to accommodate a spigot of the fitting, at least the orientation of said narrower portion relative to said first position defining a permitted alignment for said fitting.

The shape of said first portion of said fitting may closely follow a non-circular outline.

The edges that bear on features of said head may comprise the edge of at least one aperture that fits over a feature of said head.

The aperture may be sized and shaped to closely accommodate the said feature of said head. The said feature may be a hub of the head.

In a still further aspect the invention may broadly be said to consist in a method of securing a fitting into a wafer carrier head assembly, said method including the steps of:

locating a tool as described above with said aperture positioned above the and said edges bearing against said features of said head;

placing the hollow body of the elbow fitting within said aperture oriented as allowed for by the said aperture; and securing said body in position and orientation before removing said tool.

The step of securing may comprise inserting a threaded fastener through said hollow body to engage in a threaded seat in said head and tightening said threaded fastener in position.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

DETAILED DESCRIPTION

Figure 1:
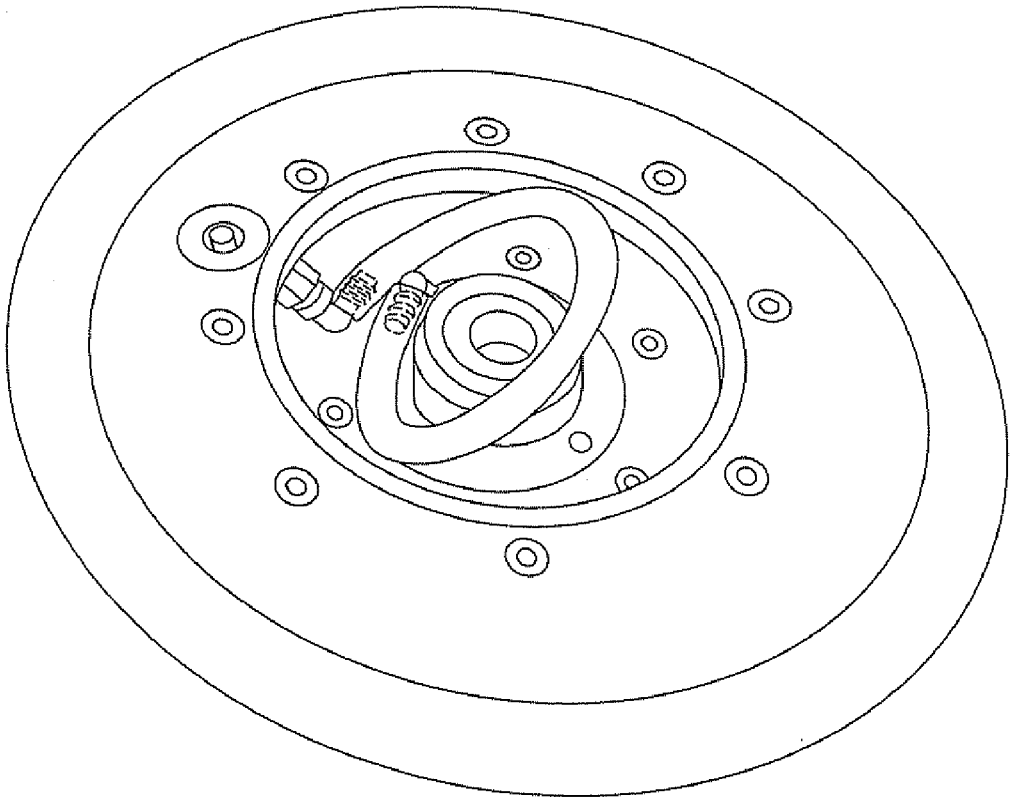
Fig. 1 Prior Art
FIG. 1 is a perspective view of a subassembly of a TITAN HEAD wafer carrier according to the prior art, showing the inflatable tube and the flexible plastic supply tube.

FIG. 1 illustrates an existing TITAN HEAD wafer carrier as described above in the summary of the prior art including swivelling elbow fittings.

According to the present invention the swivelling elbow fitting in the TITAN HEAD assembly is replaced by a fixed elbow fitting oriented in a predetermined direction that allows the flexible plastic tube an unobstructed path between the fitting and the corresponding fitting on the inflatable tube.

Figure 2:
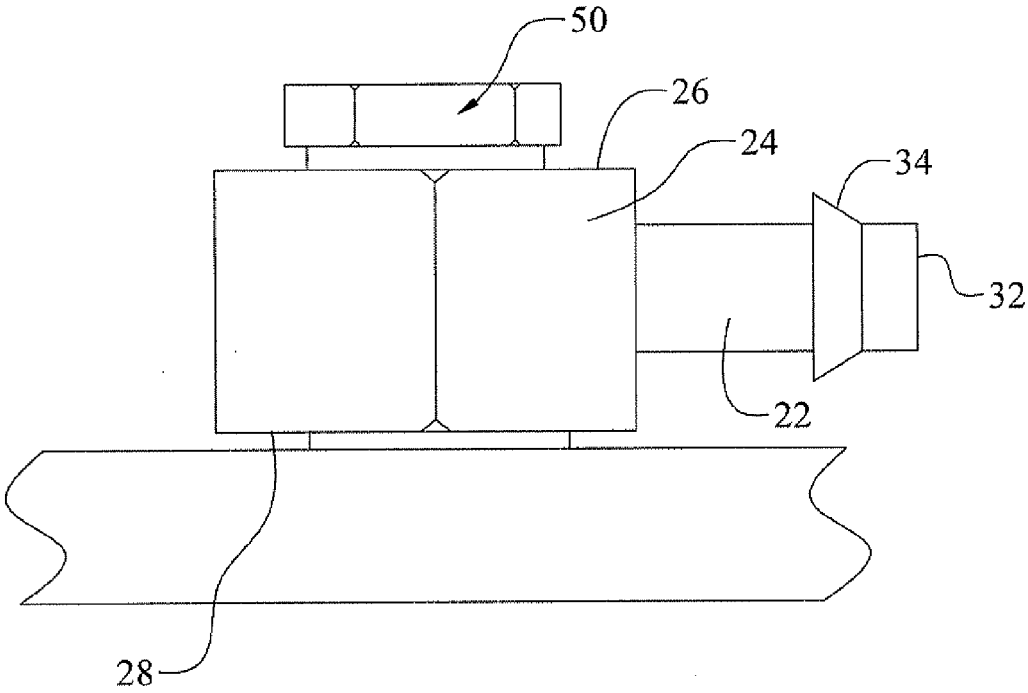
FIG. 2 is a side view of an elbow fitting according to the present invention.
Figure 3:
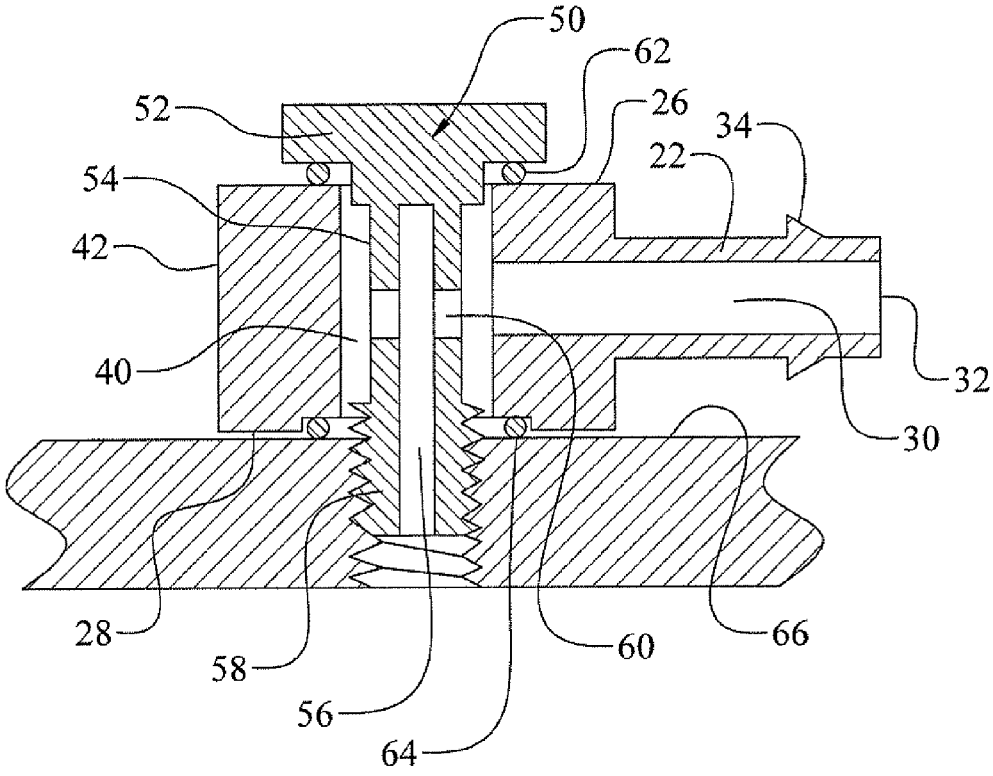
FIG. 3 is a cross-sectional side elevation of the fitting of FIG. 2.

An exemplary fixed position elbow fitting is illustrated in FIGS. 2 and 3. The fitting includes a main body 24 with a spigot 22 extending from the side wall of the body. The spigot 22 has a bore 30 extending from inside the main body through to open at the end 32 of the spigot. The external surface of the spigot has one or more annular barbs 34 for gripping the inside of the flexible plastic tube.

The main body has a top face 28 and a bottom face 26. A central passage 40 extends through the main body from the top face 28 to the bottom face 26. The side wall 42 of the main body is preferably shaped to allow it to be gripped, or at least restrained from rotation by the template according to another aspect of the invention. For this purpose the side wall may be faceted, for example to have six or eight sides.

The bore through the spigot 22 extends to adjoin the passage 40 through the main body. To secure the fitting, a screw 50 passes through the passage of the main body. The screw has a head 52 broader than the passage 40 and a shank 54 which has a clearance fit within the passage. The screw has a hollow central passage 56 extending axially through the shank 54, entering the shank at the threaded end 58. An exit aperture 60 is provided through the side of the shank in the region adjacent the head of the screw. With the screw tightened into position, a gases pathway is provided through the hollow shank of the screw into the passage of the main body to the bore of the spigot.

A first resilient seal 62 is provided between the screw head 52 and the bottom face 26 of the main body. A second resilient seal 64 is provided for the top face 28 of the main body. With the fitting installed, the first resilient seal 62 is between the screw head and the bottom face of the body, and the second resilient seal 64 is compressed between the top face 28 of the main body and the surface 66 of the TITAN HEAD head assembly.

Preferably each resilient seal is a resilient O-ring of any suitable elastomeric material.

Preferably the main body of the fitting, including the spigot, is formed of a suitable grade of stainless steel. Preferably the screw is also of any suitable grade of stainless steel.

According to another aspect of the present invention a tool 70 is provided specifically adapted for installing the fitting, so that it can be secured in place in the desired predetermined orientation. The tool is a substantially planar member 72 having an aperture 76 associated with the fitting and edges 74 that are intended to bear against features of the head assembly. With the edges of the tool bearing on the respective features and the aperture for the fitting is in position above the intended position for the fitting (the threaded outlet for the pressurised gas supply), the aperture for the fitting has a predetermined orientation that only allows the fitting to be inserted through the aperture in the one predetermined orientation. The tool holds the fitting in this predetermined orientation until the tool is lifted away from the head assembly. In an exemplary method for installing the fitting, the tool 70 is only removed once the fitting is securely fastened to a degree that it will not rotate out of position.

Figure 4:
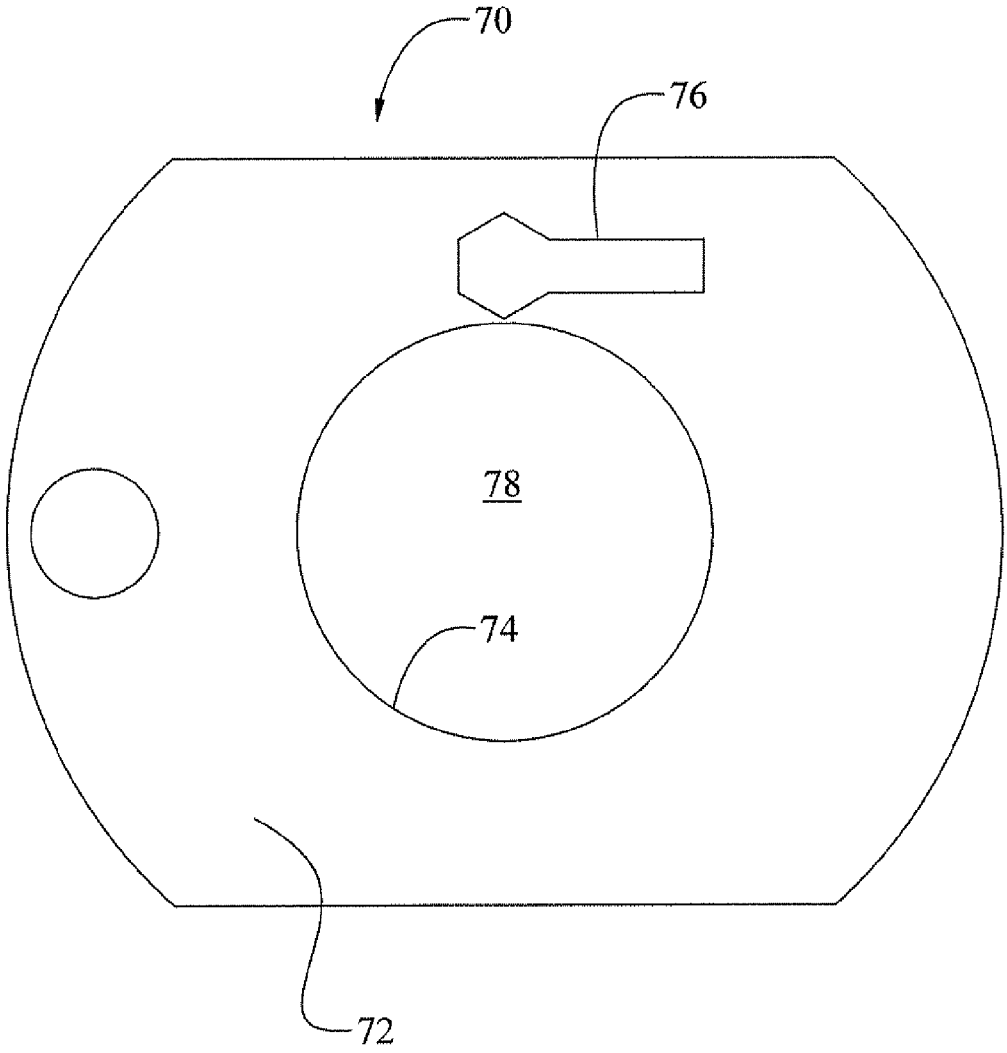
FIG. 4 is a plan view of a tool for assisting installing of the improved elbow fitting.

An exemplary tool will be described in detail with reference to FIG. 4. The tool has a planar body 72. An aperture 76 passes through the planar body at one location. This aperture 76 is a silhouette of the plan view of the preferred fitting. This aperture has a first portion shaped to closely accommodate the plan shape of the body of the fitting and a second portion closely accommodating the plan shape of the spigot.

Figure 5:
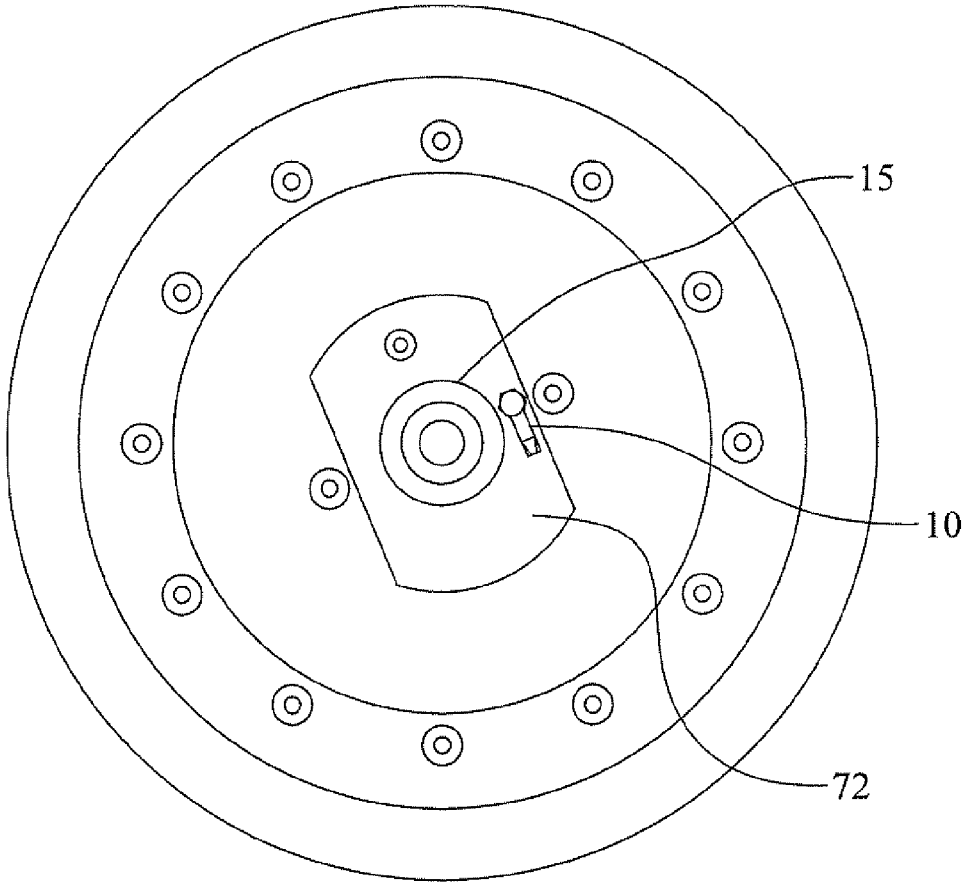
FIG. 5 is a plan view illustrating application of the tool of FIG. 5 in relation to the wafer carrier of FIG. 1.

The exemplary tool includes at least one other aperture, which is intended to accommodate a feature or features of the wafer carrier head assembly. For example, a fast circular aperture 78 is sized and located to accommodate a hub portion of the head assembly. This is illustrated in FIG. 5 where the tool is shown applied over the hub portion 15 with a fitting according to another aspect of the present invention also in place. The fitting 10 is aligned by the orientation of aperture 32.

The position of the fitting aperture 76 is such that the fitting aperture is placed centrally above the threaded gases supply port when the tool is in place with the respective hub feature protruding through the first aperture 78. Furthermore, the fitting aperture 76 is oriented relative to the location of the first aperture 78 to accord with the predetermined orientation desired for the installed fitting.

Preferably the tool is a circular body of overall size to fit within the bell shaped housing of the head assembly. The tool may be formed from any sheet material, such as aluminium plate.

To install the fitting according to one aspect of the present invention using the tool according to another aspect of the present invention the operator follows the following steps:

- placing the template in the bell housing of the head assembly with the hub portion protruding through the first aperture, and the fitting aperture aligned over the mounting hole;
- place the body of the fitting within the fitting aperture of the tool, oriented with the spigot of the fitting aligned in the spigot portion of the aperture;
- inserting the hollow screw through the passage of the main body and threading the screw into the threaded outlet of the head assembly,
- tightening the screw to a predetermined torque setting, for example 1.5 Nm; and
- removing the alignment tool from the head assembly and completing reassembly of the TITAN HEAD.

The inventors have found that the fitting according to the present invention, installed as described, has reduced the instances of failures which had been associated with the previous swivelling elbow fitting. With the fixed elbow fitting properly aligned using the alignment tool no detriment from lack of swivel function has been observed.

The invention claimed is:

1. An improvement for a wafer carrier having an annular inflatable tube for exerting pressure on an edge of a perforated plate during wafer dechucking, and a flexible plastic tube for supplying pressure to the annular inflatable tube, the improvement comprising a fixed elbow fitting secured to said wafer carrier, said fixed elbow fitting including a body having a first hollow spigot for receiving one end of said flexible plastic tube and a bore extending through said body at a generally right angle to said hollow spigot between a top face of said body and a bottom face of said body, a seal sandwiched between said top face of said body and said wafer carrier, a hollow screw extending through said bore of said body for securing the fixed elbow fitting to the wafer carrier, with a seal between a head of said screw and the bottom face of said body; with said body held clamped in a fixed position by said screw with said spigot in a predetermined orientation, said orientation being such that said flexible plastic tube will not be obstructed in its path between said fixed elbow fitting and said inflatable tube and will not obstruct the bellows operation of said wafer carrier.

2. An improvement as claimed in claim 1 wherein each said seal comprises a resilient O-ring.

3. An improvement as claimed in claim 2 wherein a side surface of said body of said fixed elbow fitting has a non-circular outline.

4. An improvement as claimed in claim 3 wherein said side surface of said body of said fixed elbow fitting has a plurality of facets.

5. A tool for assisting the fitting of a fixed orientation elbow fitting within a wafer carrier, the elbow fitting having a body with a spigot, the wafer carrier having an annular inflatable tube for exerting pressure on one or more edges of a perforated plate during wafer dechucking, and a conduit for supplying pressure to the annular inflatable tube, said tool comprising a planar or substantially planar rigid body having an aperture shaped to accommodate the elbow fitting in a predetermined orientation relative to the tool, and one or more edges shaped to engage at least a portion of the wafer carrier so that said tool may be positively located at a predetermined orientation relative to the wafer carrier, whereby the aperture of said tool is at a fixing position for fixing said elbow fitting to the wafer carrier when the one or more edges of said tool are engaged with the wafer carrier thereby positively locating the tool at the predetermined orientation relative to the wafer carrier.

6. A tool as claimed in claim 5 wherein said aperture has a first portion shaped to accommodate the body of the elbow fitting and a narrower portion extending from said first position to accommodate the spigot of the elbow fitting, at least the orientation of said narrower portion relative to said first position defining a permitted alignment for said elbow fitting.

7. A tool as claimed in claim 6 wherein the shape of said first portion of said aperture closely follows a non-circular outline.

8. A tool as claimed in claim 5 wherein said one or more edges that engage at least a portion of the wafer carrier comprise the edge of at least one aperture that fits over a feature of said wafer carrier.

9. A tool as claimed in claim 8 wherein said one or more edges comprise the edges of more than one aperture, and each aperture is positioned to accommodate a different feature of said wafer carrier.

10. A tool as claimed in claim 9 wherein said apertures are sized and shaped to closely accommodate the said features of said wafer carrier.

11. A tool as claimed in claim 10 wherein one said aperture is provided for a hub portion of said wafer carrier and there is at least one other said aperture in addition to said aperture for said fitting.

12. A tool as claimed in 6 wherein said one or more edges that engage at least a portion of the wafer carrier comprise the edge of at least one aperture that fits over a feature of said wafer carrier.

13. A tool as claimed in claim 7 wherein said one or more edges that engage at least a portion of the wafer carrier comprise the edge of at least one aperture that fits over a feature of said wafer carrier.

14. A tool as claimed in claim 12 wherein said aperture is sized and shaped to closely accommodate the said feature of said wafer carrier.

15. A tool as claimed in claim 13 wherein said aperture is sized and shaped to closely accommodate the said feature of said wafer carrier.

16. A tool as claimed in claim 12 wherein said feature of said wafer carrier is a raised hub of said wafer carrier.

17. A tool as claimed in claim 13 wherein said feature of said wafer carrier is a raised hub of said wafer carrier.

18. A method of securing a fitting into a wafer carrier head assembly having an annular inflatable tube for exerting pressure on one or more edges of a perforated plate during wafer dechucking, and a conduit for supplying pressure to the annular inflatable tube, said method including the steps of:

locating a tool relative to the wafer carrier head assembly, the tool comprising a planar or substantially planar rigid body having an aperture shaped to accommodate the fitting in a predetermined orientation relative to the tool, and one or more edges shaped to engage at least a portion of the wafer carrier head assembly so that the tool may be positively located at a predetermined orientation relative to the wafer carrier head assembly with said aperture positioned at a fixing position for fixing the fitting to the wafer carrier head assembly when the one or more edges of said tool are engaged with the the wafer carrier assembly;

placing a hollow body of the fitting within said aperture oriented as allowed for by the said aperture; and securing said body in position and orientation before removing said tool.

19. A method as claimed in claim 18 wherein said step of securing comprises inserting a threaded fastener through said hollow body to engage in a threaded seat in said wafer carrier head assembly and tightening said threaded fastener in position.

* * * * *